US006385850B1

(12) United States Patent
Coulthard, Jr.

(10) Patent No.: US 6,385,850 B1
(45) Date of Patent: May 14, 2002

(54) RAZOR AND METHOD FOR CLEANING

(75) Inventor: Robert Stanley Coulthard, Jr., Lynn Haven, FL (US)

(73) Assignee: Common Sense Systems, Inc., Lynn Haven, FL (US)

( * ) Notice: Subject to any disclaimer, the term of this patent is extended or adjusted under 35 U.S.C. 154(b) by 0 days.

(21) Appl. No.: 09/698,081

(22) Filed: Oct. 30, 2000

(51) Int. Cl.[7] ..... B26B 21/22
(52) U.S. Cl. ..... 30/41.5
(58) Field of Search ..... 30/41, 41.5, 50, 30/43.92, 346.51

(56) References Cited

U.S. PATENT DOCUMENTS

| | | | | |
|---|---|---|---|---|
| 4,047,296 | A | | 9/1977 | Ishida et al. |
| 4,205,437 | A | | 6/1980 | Chen et al. |
| 4,226,019 | A | | 10/1980 | Sugiyama |
| 4,257,160 | A | | 3/1981 | Murai |
| 4,395,822 | A | | 8/1983 | Ciaffone |
| 4,574,476 | A | | 3/1986 | Ortiz |
| 4,774,765 | A | | 10/1988 | Ferraro |
| 4,939,840 | A | | 7/1990 | Butka |
| 5,005,288 | A | | 4/1991 | Wilk |
| 5,313,706 | A | | 5/1994 | Motta et al. |
| 5,402,574 | A | | 4/1995 | Milner |
| 5,537,749 | A | | 7/1996 | Cacioppo |
| 5,544,415 | A | * | 8/1996 | Huang ..... 30/43.92 |
| 5,557,851 | A | | 9/1996 | Ortiz |

* cited by examiner

*Primary Examiner*—Douglas D. Watts
(74) *Attorney, Agent, or Firm*—Jones, Tullar & Cooper, PC

(57) ABSTRACT

A razor has a blade unit containing a plurality of spaced blades. The blades are mounted in a manner which enables them to be readily moved apart to provide access to the space between the blades to facilitate the cleaning and removal of any lodged material from between the blades. Upon completion of cleaning, the blades are returned to their original position and are ready to again be used for shaving. A number of exemplary embodiments of the invention are described. Under an additional aspect, the invention is directed to a method of cleaning a multiple-bladed razor. Under the method, the blades are spread apart and the area between the blades is cleaned with a stream of water or the like. The blades are then returned to their original positions for further use in shaving.

19 Claims, 3 Drawing Sheets

RAZOR AND METHOD FOR CLEANING

BACKGROUND OF THE INVENTION

1. Field of the Invention

The present invention generally relates to a razor and more particularly to a safety razor having a blade unit with a plurality of blades and a means for spreading the blades apart to facilitate cleaning debris from between the blades.

2. Description of the Prior Art

It has become commonplace in recent years for safety razors to be equipped with blade units having two or more blade elements disposed on the head of the razor. These razors are generally known as twin-bladed razors, multi-bladed razors, and the like. In these razors, the blades are mounted in a parallel spaced relationship to each other so as to provide a leading cutting edge and a following cutting edge which, during a single shaving stroke, are successively engaged with the hair being shaved. This arrangement is believed to provide a closer shave than would be the case if only a single blade were used.

However, during shaving with razors having two or more such parallel spaced blade elements, hair, shaving cream, and other debris can become lodged in the space between the blades. The lodged material can decrease the effectiveness of the razor, thereby producing inferior results. Accordingly, it is desirable to remove the lodged material at a suitable time during and/or after shaving. In the past, the lodged material has been removed by rinsing and pounding the razor head on the side of a sink. Other prior art methods include pushing or ejecting devices which move between the blades in a wiping manner for ejecting the lodged material from between the blades. Yet other prior art razors include specially formed channels or passages for directing water against the lodged material. However, none of the prior art methods have proven to be ideal. Consequently, it is apparent that there is a continuing need for a razor having blade elements that can be readily cleaned during and after shaving, and which cleaning can completely and easily remove all the material lodged between the blades. The present invention sets forth such a razor and method for cleaning the material from between blade elements.

SUMMARY OF THE INVENTION

Under a broad aspect, the present invention is directed to a razor having a blade unit containing a plurality of blades. The blades are preferably mounted in a manner which enables them to be readily moved apart to provide access to the space between the blades to facilitate the cleaning and removal of any lodged material. Upon completion of cleaning, the blades are returned to their original position and are ready to again be used for shaving. A number of exemplary embodiments of the invention are described below.

Under an additional aspect, the invention is directed to a method of cleaning a multiple-bladed razor. Under the method, the blades are spread apart by an actuator and the area between the blades is cleaned. The blades are then returned to their original positions for further use in shaving.

BRIEF DESCRIPTION OF THE DRAWINGS

The foregoing and additional objects, features, and advantages of the present invention will become apparent to those of skill in the art from a consideration of the following detailed description of preferred embodiments of the invention, taken in conjunction with the accompanying drawings.

DETAILED DESCRIPTION

The present invention sets forth a razor having a plurality of blades wherein the blades can be moved apart from one another to facilitate cleaning between the blades. As illustrated in FIGS. 1*a*–1*d*, a first embodiment of a razor 10 includes a handle 12, a neck 14, and a blade unit 16 mounted on top of neck 14. Razor 10 may be of the disposable type, may be of the type in which only the blade unit is replaceable on a non-disposable handle, or may be otherwise configured as is known in the art.

Figure 1B:
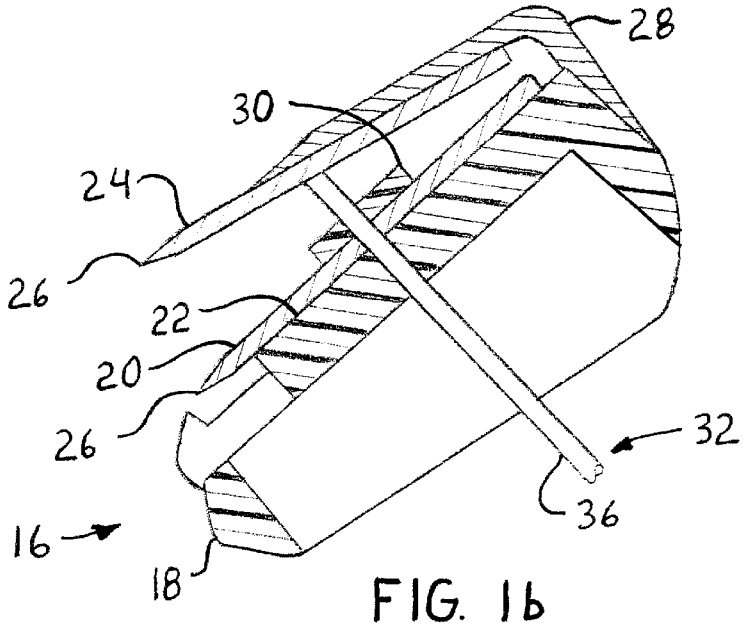
FIG. 1*b* illustrates an enlarged cross sectional view of the blade unit of the razor of FIG. 1*a*.
Figure 1A:
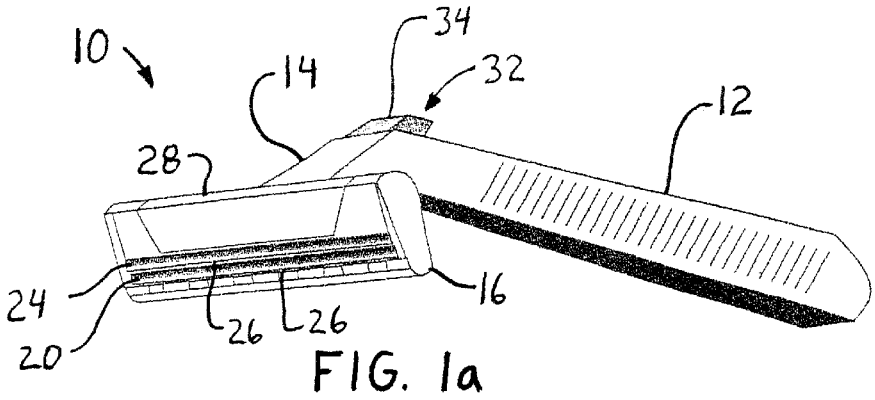
FIG. 1*a* illustrates a perspective view of a first embodiment of the razor of the invention.
Figure 1C:
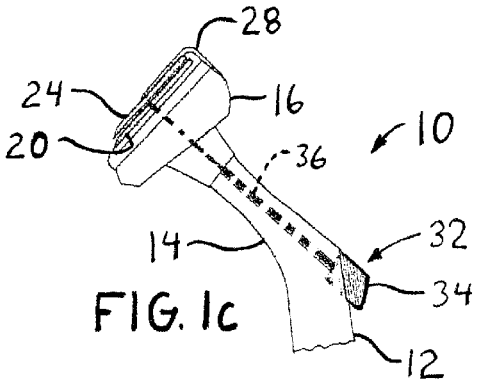
FIG. 1*c* illustrates a side view of the razor of FIG. 1*a*.

As illustrated in FIG. 1*b*, blade unit 16 includes a head 18 having a first blade element 20 mounted on a shelf portion 22. A second blade element 24 is mounted adjacent to first blade element 20 in a spaced relationship and in a manner such that the edges 26 of blade elements 20, 24 are parallel. Second blade element 24 is normally disposed in a plane parallel to first blade element 20, as illustrated in FIG. 1*c*, which creates as space between blade elements 20, 24. Blade element 24 is mounted to a spring-biased pivot member 28 which enables second blade element 24 to be pivoted away from first blade element 20, as illustrated in FIGS. 1*b* and 1*c*. A spacer 30 is included between blade elements 20, 24 so as to maintain the space between blade elements 20, 24 during shaving.

Figure 1D:
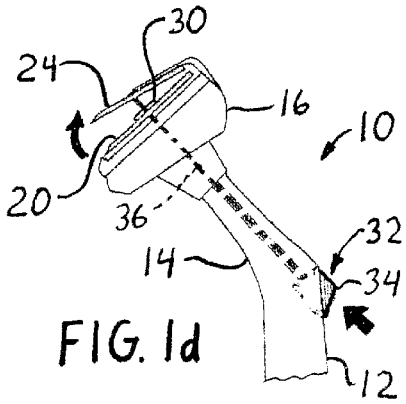
FIG. 1*d* illustrates the razor of FIG. 1*c* with the actuator actuated to increase the space between the blade elements.

An actuator 32 is included for moving second blade element 24 away from first blade element 20 when it is desirable to remove any lodged material from between blade elements 20, 24. As illustrated in FIGS. 1*c*–1*d*, actuator 32 includes a push button 34 mounted in handle 12. A push rod 36 extends through neck 14 and contacts second blade element 24. As illustrated by the arrows in FIG. 1*d*, push button 34 may be depressed inward to press push rod 36 against blade element 24. This causes second blade element 24 to pivot away from first blade element 20 to increase the space between the blade elements 20, 24 so as to more readily enable cleaning of the space between blade elements 20, 24.

In use, during shaving, the space between first blade element 20 and second blade element 24 will become filled with shaving cream, hair particles, skin debris, and the like. As the space becomes filled, the user may actuate actuator 32 by depressing push button 34. This causes second blade element 24 to move away from first blade element 20, thereby enlarging the space between blade elements 20, 24. The user may then clear any materials from the space between blade elements 20, 24 by rinsing with a stream of water or the like. Following cleaning of the space between blade elements 20, 24, the user releases actuator 32, and the spring bias of pivot member 28 causes second blade element 24 to return to a generally parallel spaced relationship adjacent to first blade element 20. The spring bias of pivot member 28 is sufficient to retain second blade element 24 in the shaving position adjacent to first blade element 20 during normal use of razor 10. Pivot member 28 may be made of resilient plastic, spring steel, or other suitable materials.

Figure 2A:
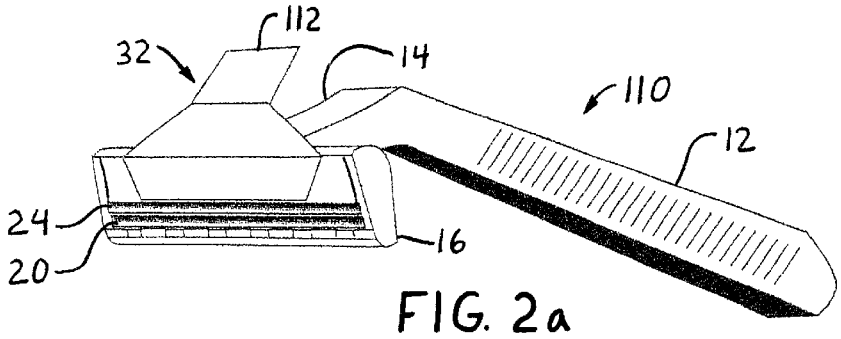
FIG. 2*a* illustrates a perspective view of a second embodiment of the razor of the invention.
Figure 2C:
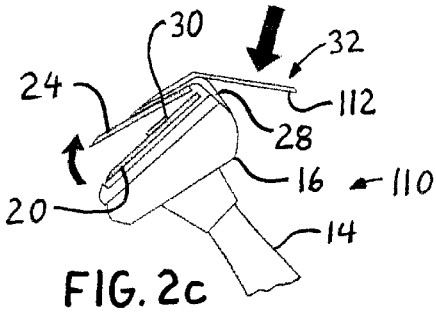
FIG. 2*c* illustrates the razor of FIG. 2*b* with the actuator actuated to increase the space between the blade elements.
Figure 2B:
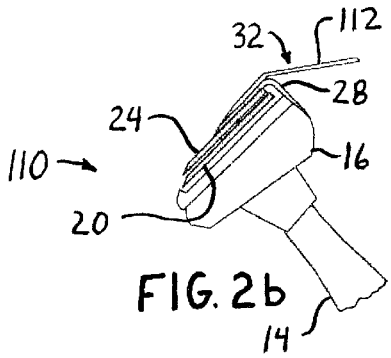
FIG. 2*b* illustrates a side view of the razor of FIG. 2*a*.

FIGS. 2*a*–2*c* illustrate a second embodiment of a razor 110 of the invention. In all embodiments of the invention, identical parts will be given identical reference numbers, and further description of these parts is not believed necessary. Accordingly, razor 110 includes an actuator 32 which comprises a thumb lever 112 which is in communication with second blade element 24 through pivot member 28. Handle 10 may be gripped by the hand of the user, and the user may press down on thumb lever 112 with a thumb to actuate thumb lever 112. As illustrated by the arrows in FIG. 2*c*, when lever 112 is depressed, second blade element 24 is moved away from first blade element 20. This enables the space between blade elements 20, 24 to be cleaned in the manner described above.

Figure 3A:
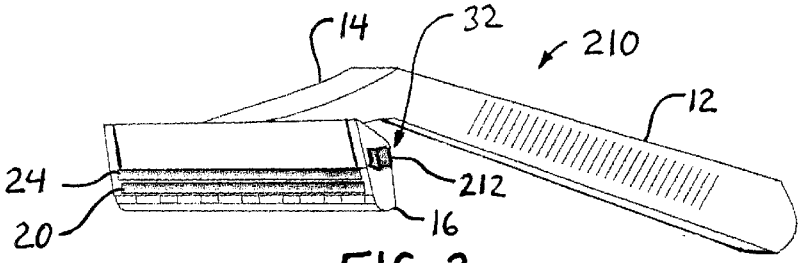
FIG. 3*a* illustrates a perspective view of a third embodiment of the razor of the invention.
Figure 3B:
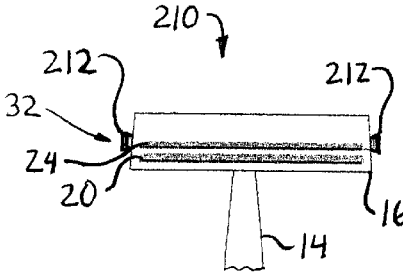
FIG. 3*b* illustrates a front elevation view of the razor of FIG. 3*a*.
Figure 3C:
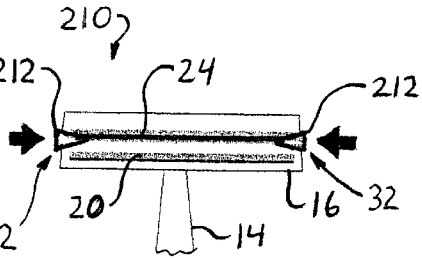
FIG. 3*c* illustrates the razor of FIG. 3*b* with the actuator actuated to increase the space between the blade elements.
Figure 3D:
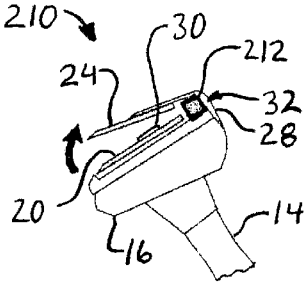
FIG. 3*d* illustrates a side view of the razor of FIG. 3*c*.

FIGS. 3*a*–3*d* illustrate a third embodiment of a razor 210 of the invention. Actuator 32 of razor 210 includes a pair of wedge-shaped buttons 212 which are mounted on blade unit 16 so as to be movable inward toward each other. A user may squeeze blade unit 16 between a thumb and forefinger to depress wedge-shaped buttons 212. As illustrated in FIGS. 3*c*–3*d*, as wedge-shaped buttons 212 are pressed inward, second blade element 24 separates from first blade element 20 to increase the space between blade elements 20, 24 so as to facilitate cleaning. Upon release of buttons 212, the spring bias of pivot member 28 forces second blade element 24 back into the original shaving position, which also returns wedge-shape buttons 212 to their original positions.

Figure 4A:
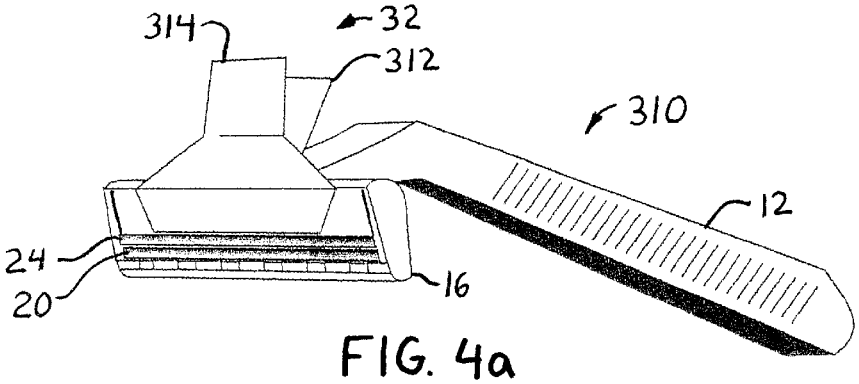
FIG. 4*a* illustrates a perspective view of a fourth embodiment of the razor of the invention.
Figure 4B:
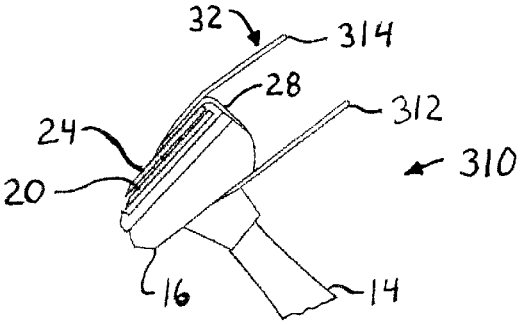
FIG. 4*b* illustrates a side view of the razor of FIG. 4*a*.
Figure 4C:
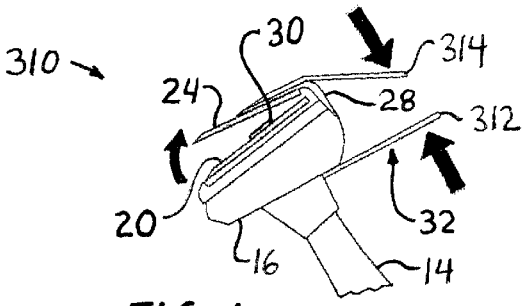
FIG. 4*c* illustrates the razor of FIG. 4*b* with the actuator actuated to increase the space between the blade elements.

FIGS. 4*a*–4*c* illustrate a fourth embodiment of a razor 310 of the invention. Actuator 32 of razor 310 includes a first lever 312 connected to the underside of blade unit 16 and extending rearward from blade unit 16. A second lever 314 is connected to second blade element 24 through pivot member 28, and also extends rearward from blade unit 16. By squeezing between a thumb and forefinger, a user may depress second lever 314 toward first lever 312. As illustrated in FIG. 4*c*, depression of second lever 314 toward first lever 312 causes second blade element 24 to move away from first blade element 20 to facilitate cleaning between blade elements 20, 24.

Figure 5A:
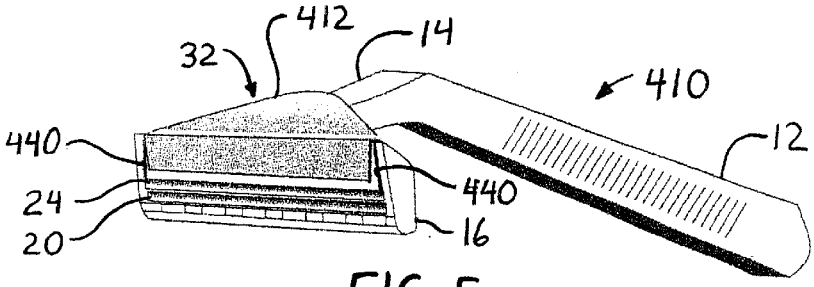
FIG. 5*a* illustrates a perspective view of a fifth embodiment of the razor of the invention.
Figure 5B:
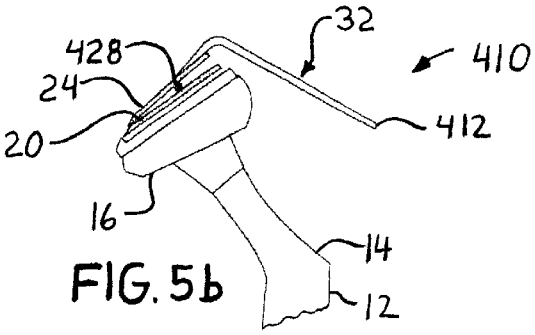
FIG. 5*b* illustrates a side view of the razor of FIG. 5*a*.
Figure 5C:
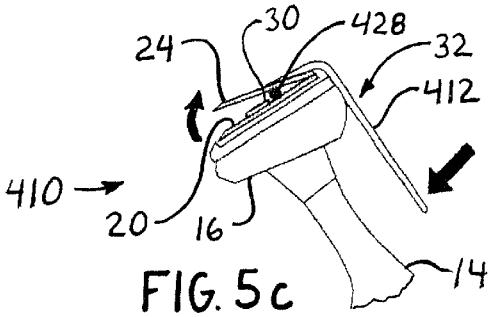
FIG. 5*c* illustrates the razor of FIG. 5*b* with the actuator actuated to increase the space between the blade elements.

FIGS. 5*a*–5*c* illustrate a fifth embodiment of a razor 410 of the invention. Actuator 32 includes a lever 412 which is connected to second blade element 24 and which extends rearward from blade unit 16. A hinge-type pivot member 428 is included which enables second blade element 24 to be pivoted away from first blade element 20. The edges of second blade element 24 include a snap-fit mechanism 440, such as a molded ball detent, at the interface blade unit 16. Snap-fit mechanism 440 enables second blade element 24 to be locked in the shaving position as shown in FIGS. 5*a*–5*b*. Second blade element 24 may be unsnapped to a second, open position as illustrated in FIG. 5*c*. Lever 412 may be moved in the opposite direction to close second blade element 24, so that second blade element 24 is snapped back into the shaving position and razor 410 is again ready for use. Thus, razor 410 does not rely on spring bias to retain second blade element 24 adjacent to first blade element 20 for use of razor 410, but rather, second blade element 24 is merely moveable from the shaving position to an open position by means of actuator 32.

Additional variations of the invention will also be apparent to those of skill in the art. For example, rather than relying on the spring bias of pivot member 28, first blade element 20 may be formed contiguous with second blade element 24 such that the connecting portion between blade elements 20, 24 acts as a spring member (not shown). In addition, the invention may be used with razors having more than two blade elements by providing sufficient actuators for moving the additional blade elements. Other variations of the invention will also be apparent. Accordingly, while the foregoing disclosure sets forth exemplary embodiments of the present invention, it is to be understood that the invention is not limited to the particulars of the foregoing embodiments, but is limited in scope only as set forth in the following claims.

What is claimed:

1. A razor having a blade unit, said razor comprising:

a first blade element including a first blade element edge;

a second blade element including a second blade element edge, said first and second blade elements disposed parallel to each other in a spaced relationship in a shaving position of said razor;

a pivot member connecting said first and second blade elements for pivotal movement; and an actuator for separating said first blade element and said second blade element from one another about said pivot member, whereby said actuator may be actuated to increase a space between said first and second blade element edges to facilitate cleaning of the space between said first and second blade element edges.

2. The razor of claim 1 wherein said first and second blade elements are spring-biased toward one another and said actuator moves said first and second blade elements apart against the spring bias.

3. The razor of claim 1 wherein said actuator includes a first lever connected to said first blade element, whereby said lever may be depressed to increase the space between said first blade element and said second blade element.

4. The razor of claim 3 including a blade unit head which houses said first and second blade elements and further including a second lever, said second lever being connected to said blade unit head, whereby said first lever may be depressed toward said second lever for increasing the space between said first blade element and said second blade element.

5. The razor of claim 1 wherein said actuator includes a push rod in contact with a first one of said first and second blade elements, and a push button connected to said push rod, whereby said push button may be depressed to move said push rod so as to force said first one of said first and second blade elements away from a second one of said first and second blade elements.

6. The razor of claim 1 wherein said actuator includes a pair of wedge-shaped buttons on either side of said first and second blade elements, whereby said wedge-shaped buttons may be depressed to move said first blade element away from said second blade element.

7. A razor comprising:

a blade unit mounted on a handle;

a first blade element having a first blade edge and being disposed in said blade unit;

a second blade element having a second blade edge and also being disposed in said blade unit, said second blade element edge being normally disposed adjacent to said first blade element edge in said blade unit in a spaced relationship such that there is a space between said first blade element edge and said second blade element edge;

a pivot member connecting said first and second blade elements for pivotal movement; and an actuator for moving said second blade element away from said first blade element about said pivot member so as to increase the size of the space between said first and second blade element edges to thereby facilitate cleaning said space between said first and second blade element edges.

8. The razor of claim 7 wherein said first and second blade elements are spring-biased toward one another and said actuator moves said first and second blade element edges apart against said spring bias.

9. The razor of claim 7 wherein said actuator includes a first lever connected to said second blade element, whereby said lever may be depressed to increase said space between said second blade element edge and said first blade element edge.

10. The razor of claim 9 further including a second lever, said second lever being connected to said blade unit, whereby said first lever may be depressed toward said second lever for increasing the space between said first blade element edge and said second blade element edge.

11. The razor of claim 7 wherein said actuator includes a push rod in contact with said second blade element and a push button connected to said push rod, whereby said push button may be depressed to move said push rod so as to force said second blade element edge away from said first blade element edge.

12. The razor of claim 7 wherein said actuator includes a pair of wedge-shaped buttons on either side of said first and second blade elements, whereby said wedge-shaped buttons may be depressed to move said second blade element edge away from said first blade element edge.

13. A method of cleaning a multi-bladed razor, said method comprising:

providing a razor having first and second blade elements;

providing an edge on each of said first and second blade elements;

providing a pivotal connection between said first and second blade elements;

providing an actuator which enables said first and second blade element edges to be moved away from one another about said pivotal connection between said first and second blade elements;

using said actuator and moving said first and second blade element edges apart from one another;

placing said first and second blade elements under a stream of water and cleaning a space between said first and second blade element edges; and returning said first and second blade elements to their original positions after cleaning said space between said first and second blade element edges.

14. The method of claim 13 wherein said first and second blade elements are spring-biased toward one another and further including the step of allowing said spring bias to return said first and second blade elements to their original positions.

15. The method of claim 13 wherein said actuator includes a first lever connected to one of said first and second blade elements, and further including the step of depressing said first lever to move apart said first and second blade elements.

16. The method of claim 15 including a blade unit head housing said first and second blade elements and further including a second lever, said second lever being connected to said blade unit head, and further including the step of depressing said first lever toward said second lever to move apart said first and second blade elements.

17. The method of claim 13 wherein said actuator includes a push rod in contact with one of said first and second blade elements and a push button connected to said push rod, and further including the step of depressing said push button and moving said push rod to move apart said first and second blade elements.

18. The method of claim 13 wherein said actuator includes a pair of wedge-shaped buttons on either side of said first and second blade elements, and further including the step of depressing said buttons and moving first and second blade elements apart.

19. The method of claim 13 wherein one of said first and second blade elements is held in a shaving position by a snap fit mechanism, and further including the step of unsnapping said one of said first and second blade elements to move said one of said first and second blade elements away from the other of said first and second blade elements.

* * * * *